US010315826B2

(12) United States Patent
Caboni et al.

(10) Patent No.: US 10,315,826 B2
(45) Date of Patent: Jun. 11, 2019

(54) COMPRESSIBLE CONTAINER FOR HOT FILLING

(71) Applicant: S.I.P.A. SOCIETÁ INDUSTRIALIZZAZIONE PROGETTAZIONE E AUTOMAZIONE S.P.A., Vittorio Veneto (IT)

(72) Inventors: Martino Caboni, Vittorio Veneto (IT); Michele Pollini, Vittorio Veneto (IT); Dino Enrico Zanette, Godega di Sant'urbano (IT); Matteo Zoppas, Conegliano (IT)

(73) Assignee: S.I.P.A. SOCIETA' INDUSTRIALIZZAZIONE PROGETTAZIONE E AUTOMAZIONE S.P.A., Vittorio Veneto (IT)

( * ) Notice: Subject to any disclaimer, the term of this patent is extended or adjusted under 35 U.S.C. 154(b) by 241 days.

(21) Appl. No.: 14/917,811

(22) PCT Filed: Sep. 9, 2014

(86) PCT No.: PCT/EP2014/069155
§ 371 (c)(1),
(2) Date: Mar. 9, 2016

(87) PCT Pub. No.: WO2015/032962
PCT Pub. Date: Mar. 12, 2015

(65) Prior Publication Data

US 2016/0221739 A1 Aug. 4, 2016

(30) Foreign Application Priority Data

Sep. 9, 2013 (IT) ..... RM2013A0500

(51) Int. Cl.
*B65D 79/00* (2006.01)
*B65D 1/02* (2006.01)

(52) U.S. Cl.
CPC ..... *B65D 79/005* (2013.01); *B65D 1/0223* (2013.01); *B65D 1/0246* (2013.01);
(Continued)

(58) Field of Classification Search
CPC ..... B65D 2501/0036; B65D 2501/00; B65D 2501/0027
See application file for complete search history.

(56) References Cited

U.S. PATENT DOCUMENTS 5,758,790 A 6/1998 Ewing, Jr.
2006/0289378 A1* 12/2006 Zhang ..... B65D 1/0223 215/381

(Continued)

FOREIGN PATENT DOCUMENTS

JP 2009007026 1/2009

OTHER PUBLICATIONS

Italian Search Report and Written Opinion dated Dec. 23, 2014 for corresponding International patent application No. PCT/EP2014/069155.

*Primary Examiner* — Andrew T Kirsch
*Assistant Examiner* — Don M Anderson
(74) *Attorney, Agent, or Firm* — Abelman, Frayne & Schwab

(57) ABSTRACT

The invention relates to a container (100) for drinks suitable for hot filling and compressible so as to be able to draw the drink out by means of a pressure exerted on the side walls. The container comprises a central body (3) with vacuum compensation function which is created following the cooling of the fluid after the hot filling. Said central body comprises four trapezoidal-shaped panels (1) and is limited (Continued)

on the top and on the bottom by a set of ribs (6,7) and rings (8,9).

14 Claims, 5 Drawing Sheets

(52) U.S. Cl.
CPC ..... *B65D 1/0276* (2013.01); *B65D 1/0284* (2013.01); *B65D 2501/0018* (2013.01); *B65D 2501/0036* (2013.01)

(56) References Cited

U.S. PATENT DOCUMENTS

| | | | |
|---|---|---|---|
| 2007/0075032 | A1 | 4/2007 | Kelley et al. |
| 2011/0220668 | A1 | 9/2011 | Steih et al. |

* cited by examiner

COMPRESSIBLE CONTAINER FOR HOT FILLING

CROSS REFERENCE TO RELATED APPLICATIONS

This application is a national phase of PCT application No. PCT/EP2014/069155, filed Sep. 9, 2014, which claims priority to IT patent application No. RM2013A000500, filed Sep. 9, 2013, all of which are incorporated herein by reference thereto.

FIELD OF THE INVENTION

The present invention relates to a compressible plastic container of the hot filled type provided with vacuum compensation panels.

PRIOR ART

Nowadays, containers made of plastic, such as PET, have nearly entirely replaced all other container types for the disposable market. PET containers have the benefit of being very light, low-cost and manufacturable in large amounts by means of a stretching-blowing process. This process includes the formation of PET preforms by injection molding; the preforms thus obtained are subsequently heated, then elongated longitudinally and inflated in a specific molding cavity so as to make them reach the shape of the desired container. PET is a relatively expensive material, and it is thus important to develop containers which are as light as possible. The need to limit the amount of PET leads to containers the structure of which must be capable of adequately compensating for the low strength caused by the wall thinness which can be achieved by using PET. This container design problem is accentuated in containers for drinks which must be filled with a so-called hot fill process, i.e. with hot liquid. Said process implies a liquid temperature of about 85 degrees centigrade at the time of filling, i.e. a temperature sufficient for complete sterilization. Without an adequate design of the container, this could collapse or be irreparably deformed, again because of the thin walls. This type of container normally has a base and a cylindrical body, a shoulder and a neck. After filling, the bottle is closed and the cooling process of the liquid creates a negative pressure inside, which may cause a shrinkage of the bottle because of the concurrent effect of the contraction of the liquid volume and the contraction of the air volume present in the gap between the upper surface of the liquid and the inner wall of the cap. The bottle must thus be designed with a structural configuration such to be able to withstand such a shrinkage. In order to obtain a higher strength and avoid the collapsing of the bottle, bottles with cylindrical body walls containing vacuum compensation panels are generally made. The function of these panels is to yield towards the inside of the bottle, and thus accompany the decrease of volume of the cooled liquid. However, this bending causes strain spots at the edges of the panels which must be compensated by ribs generally arranged between one panel and the next, and by horizontal ribs arranged over and under the panel, which reinforce the structure and thus the rigidity of the bottle.

On the other hand, in case of bottles which are intentionally compressible so as to draw the liquid out by means of a pressure exerted by the user on the walls in radial direction, it is important not to exceed such a rigidity which could otherwise cause the breakage of the bottle by applying the squeezing force. The need to improve the stability of these bottles thus exists, in all cases without resorting to using more plastic material and guaranteeing a sufficient yielding feature to the squeezing required by the user.

BRIEF DESCRIPTION OF THE INVENTION

It is an object of the present invention to make container for hot filling, which after the hot filling does not display an undesired squeezing and which may be compressed to draw the liquid out forcefully when the user wants to drink without this action causing permanent deformations or fracturing the container. Thus, the present invention reaches the aforedescribed object by means of a compressible container for drinks made of plastic material, e.g. PET, suitable for a hot filling process, having a longitudinal axis X and having a first length H along said longitudinal axis X, which comprises:

a) a cylindrical threaded neck for the passage of the drink,
b) a shoulder,
c) a closed bottom,
d) a central body, comprised between said shoulder and said bottom, defining a vacuum compensation area comprising four compensation panels arranged along the side walls of said central body, said compensation panels having a trapezoidal shape with a minor base to major base ratio in the range between 0.2 and 0.35, each compensation panel having the bases inverted with respect to the adjacent compensation panel, said vacuum compensation area having a second length h in the range between ½ H and ⅔ H.

Advantageously, the central vacuum compensation body is delimited on the top and on the bottom by specific ribs and by an upper ring and a lower ring defining the maximum diameter of the bottle.

Furthermore, the bottom of the container is provided with two recesses, each in a position corresponding to the compensation panels which have the major side facing towards the shoulder. Advantageously, inclined columns, which connect the upper ring and the lower ring, are provided between the panels. The maximum depth of these inclined columns is comprised in the range between 2.5 mm and 5 mm, preferably the dimension of said maximum depth is between 2.8 mm and 3.2 mm.

According to an embodiment, the panels have an even surface, i.e. without any dips and protrusions, and are curved towards the longitudinal axis X. In this way, there is advantageously provided an enhanced vacuum compensation leading to a more homogeneous deformation and therefore to a uniform final shape of the bottle when cooling is accomplished.

BRIEF DESCRIPTION OF THE FIGURES

Further features and advantages of the invention will be more apparent in light of the detailed description of a preferred, but not exclusive embodiment of a PET bottle of the type for hot filling, which may be squeezed to draw out the drink contained therein, illustrated by way of non-limiting example with the aid of the following figures.

The same reference numbers and letters in the figures refer to the same members or components.

DETAILED DESCRIPTION OF A PREFERRED EMBODIMENT OF THE INVENTION

Figure 1:
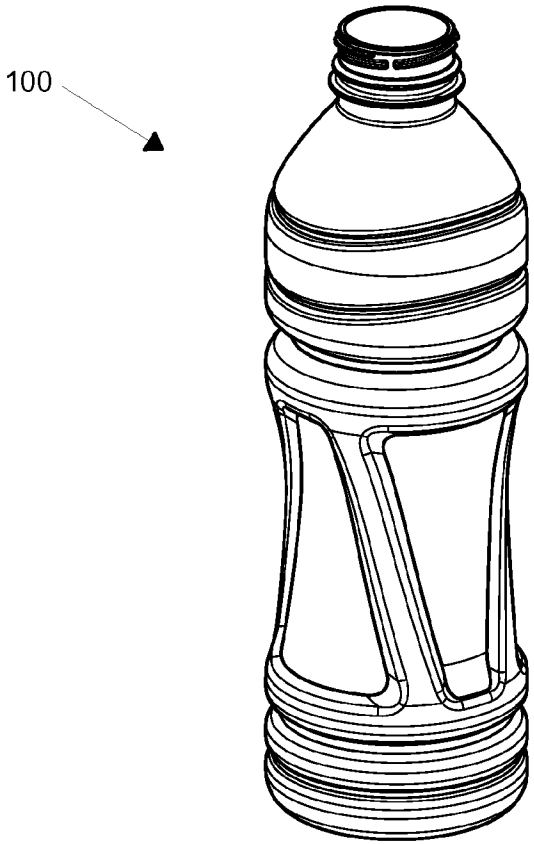
FIG. 1 is a perspective view of a ½ liter bottle according to the invention.
Figures 2A, 2B:
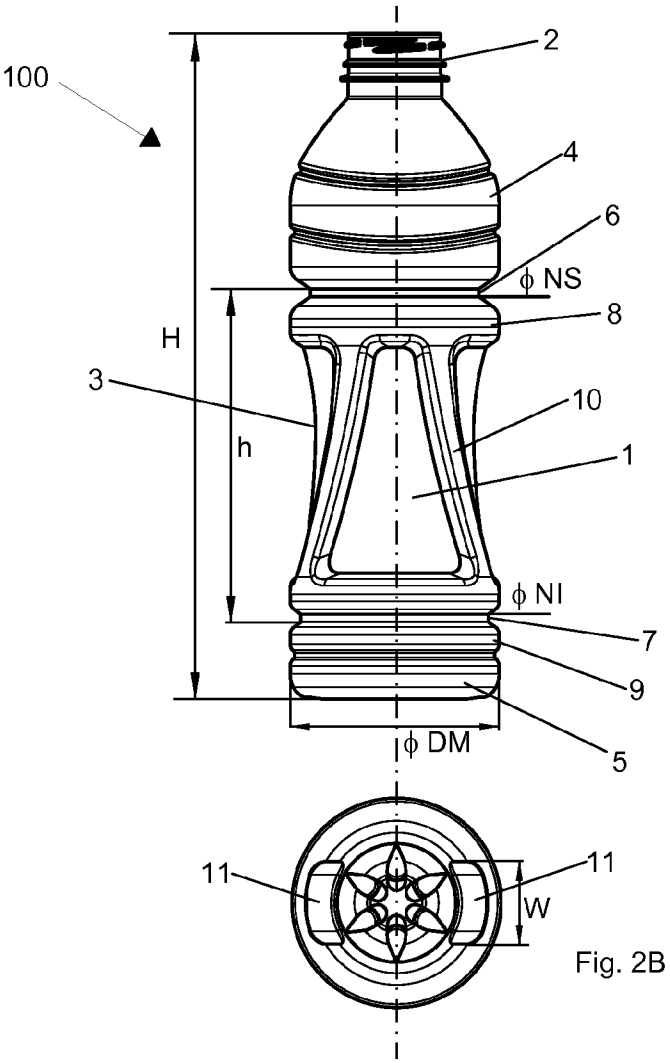
FIG. 2A and FIG. 2B are a front view and a bottom view of the same bottle.

FIG. 1 shows an axonometric view of a bottle 100 intended to contain drinks constructed according to a preferred embodiment of the invention. The bottle, preferably made of PET, is designed to be filled by means of a hot filling process; furthermore, it must be able to be compressed in order to draw the liquid out by means of a pressure exerted on the walls in substantially radial direction in order to create a jet of drink as the user desires. The bottle 100 comprises four compression panels 1 which, in addition to forming a structure for contrasting the decrease of internal pressure caused by the cooling of the drink after filling, also promote the compression of the bottle in a substantially radial direction, i.e. perpendicularly to the central axis X, FIG. 2A. The bottle 100 comprises a threaded neck 2 for closing the bottle by means of a cap (of known type) to allow the drink in and out. The bottle 1 then comprises a central body joined on the top to the neck 2 by means of a shoulder or dome 4 and on the bottom by means of a bottom 5. The central body 3 constitutes the vacuum compensation area which is delimited on the top and on the bottom by a set of rings and ribs. The upper ring 8 and the lower ring 9 are circular with a diameter DM which defines the maximum diameter of the bottle. Between the upper 8 and lower 9 ring, there is a section, perpendicular to the longitudinal axis X, where the bottle has its minimum diameter, due to the curved shape of the panels toward the longitudinal axis X before the cooling of the liquid which slightly increases when final cooling of the liquid therein contained is accomplished. The upper rib 6 and the lower rib 7 also have a circular geometry with diameters respectively equal to NS and NI. The NS/DM and NI/DM ratios between the diameters of the upper and lower ribs and the maximum diameter DM of the bottle 100 are comprised in the following ranges of values:

NS/DM between 0.85 and 0.92, preferably an average between 0.88 and 0.90

NI/DM between 0.75 and 0.85, preferably an average between 0.78 and 0.82

Said H the total height of the bottle, the height h of the vacuum compensation area is preferably comprised between ½ H and ⅔ H.

Figure 3:
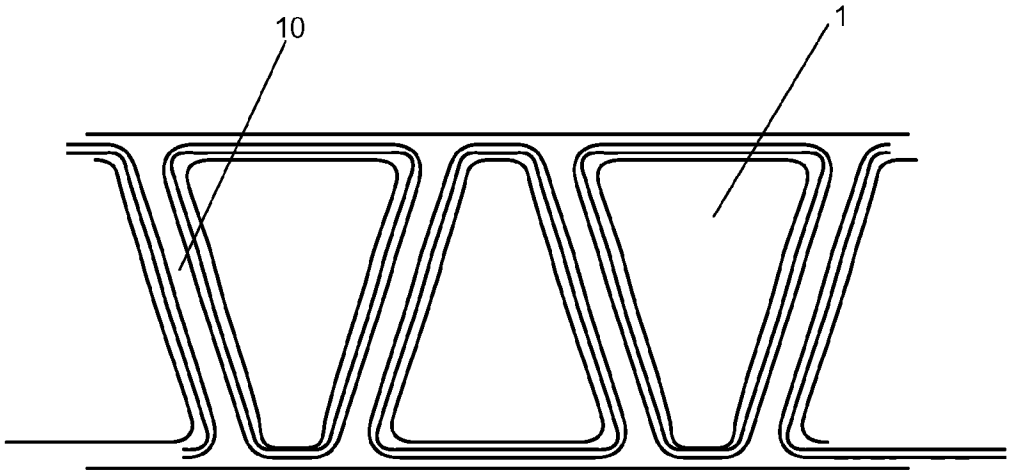
FIG. 3 shows a plane projection view of the compensation panels along the central part of the bottle.

The vacuum compensation area further comprises four compression panels 1 which are equal to each other and have a trapezoidal geometry with a ratio of the length of the minor base of the trapezium Lmin to that of the major base of the trapezium Lmax comprised in the range between 0.20 and 0.35, preferably between 0.28 and 0.29. The four compression panels 1 are arranged along the side walls of the central body 3. FIG. 3 shows a plane projection of the panels along the circumference of the body. The four panels have identical shape and dimensions, though positioned in inverted manner. As shown in that figure, the bases of each panel are inverted considering their position in respect of the adjacent upper and lower rings. In this manner, the compression panels 1 define two pairs, where one pair is formed by two panels opposite to each other and both, for example, with the minor base adjacent to the lower ring, the other pair is formed by the other two panels opposite to each other and both with the minor base adjacent to the upper ring. Inclined columns 10 which connect the upper ring 8 and the lower ring 9 are positioned between the compensation panels 1. The maximum depth "P" of these inclined columns 10 is comprised in the range between 2.5 mm and 5 mm, preferably the depth P is comprised between 2.8 and 3.2 mm. The bottom 5 comprises two recesses 11, FIG. 2B, which are positioned at the two panels 1 with the major base facing upwards, i.e. with the major base proximal to the neck 2 and adjacent to the upper ring, such recesses 11, which are arranged symmetrically on a diametrical line that passes through the center of the base of the bottle, have a width W in the range comprised between the length of the minor base and the length of major base of the panels 1. In a preferred embodiment of the bottle, the length of the recesses 11 corresponds to half the length of the major base.

Figure 4:
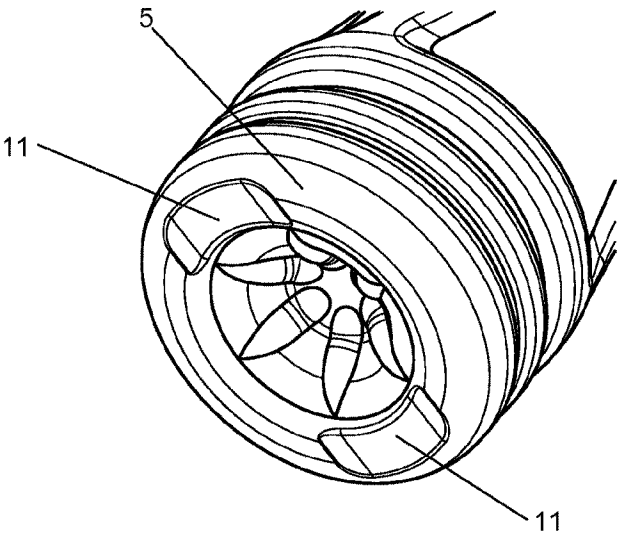
FIG. 4 is an axonometric view of the bottom of the bottle.
Figures 5A, 5B:
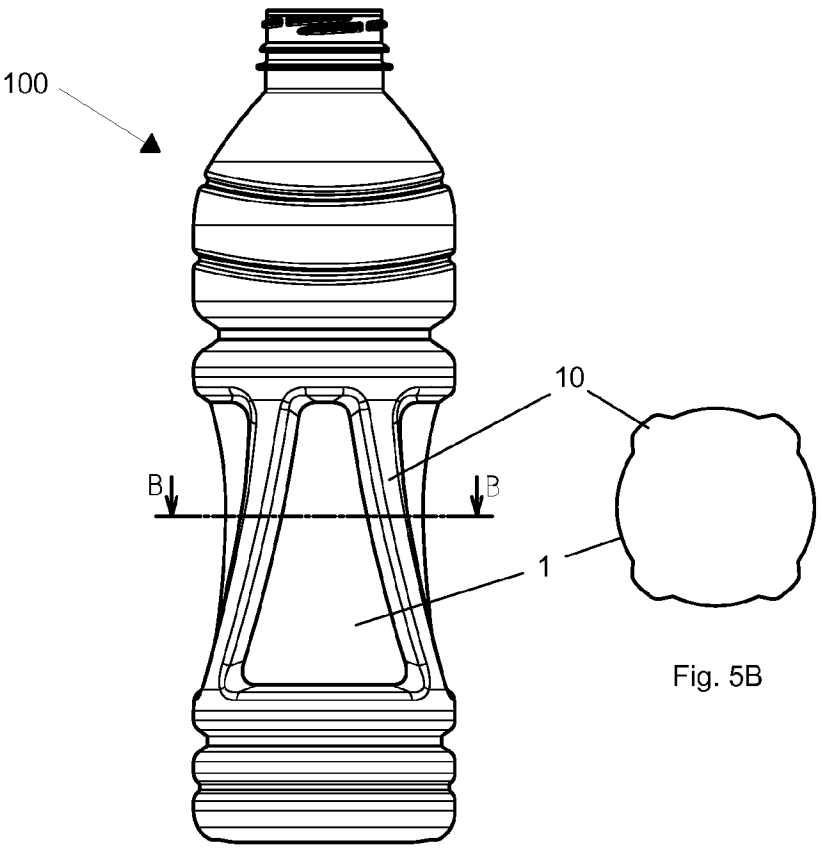
FIG. 5A and FIG. 5B are a side view and a section view of a plane transversal to the axis of the 0.5 liter bottle.

FIG. 4 shows a perspective view of the bottom 5 of the bottle 100 with the two recesses 11. FIG. 5A a shows a front view of a 0.5 liter bottle with some measurements, while FIG. 5B shows a section taken along a plane transversal to the axis of the bottle indicated by the B-B line which shows the shape of the panels 1 and of the four reinforcement columns 10 in section. The set of the upper ribs 6 and of the lower ribs 7, of the compensation panels 1 with inverted orientation between the two adjacent panels, of the inclined columns 10 and of the recesses 11 on the bottom 5 of the bottle 100 confer a structure to the bottle such as to be able to better compensate for the thermal and mechanical stresses allowing a compensation of the vacuum which is created inside the bottle during the step of cooling following the hot filling, further allowing the squeezing of the bottle to draw the liquid out without causing permanent deformations, but allowing an easy recovery of the initial shape when the squeezing force is eliminated. This configuration thus allows to keep the geometry of the bottle circular and moreover allows to make lighter bottles, 84-94% lighter than the current weights for bottles of the same capacity, i.e. allows to make bottles using less plastic material. Finally, these bottles according to the invention can also be filled at higher temperatures (88-92° C.). The bottle 100 was designed, also see FIG. 4, as a 0.5 liter container but it can be easily scaled to containers with a capacity comprised between 0.250 and 1.5 liters.

Advantageously, the recesses 11 allow a stable positioning of the bottle on a support surface, in particular when the cooling process of the liquid creates a negative pressure inside, thus avoiding undesirable tilting of the bottle. Furthermore, by means of the recesses 11, the bottom 5 is stiffer and by means of the negative pressure, it can be deformed in a controlled manner.

The invention claimed is:

1. A compressible container for a drink, made of plastic material, suitable for a hot-filling process, having a longitudinal symmetry axis X, and having a first length H along said longitudinal symmetry axis X, the compressible container comprising:

a) a cylindrical threaded neck for a passage of the drink, b) a shoulder, c) a closed bottom, d) a central body having side walls, comprised between said shoulder and said closed bottom, and defining a vacuum compensation area comprising four compensation panels arranged along the side walls of said central body, each compensation panel of said four compensation panels having a trapezoidal shape with a minor base length to major base length ratio comprised between 0.20 and 0.35, and having a minor base and a major base inverted with respect to an adjacent compensation panel, wherein the closed bottom is provided with two recesses positioned symmetrically with respect to a diametrical line passing through a center of the closed bottom, each recess of said two recesses being in a position corresponding to a compensation panel of said four compensation panels having the major base facing the shoulder, the width W of each recess of said two recesses being comprised between said minor base length and said major base length.

2. The compressible container according to claim 1, wherein said vacuum compensation area is delimited at its top by an upper rib having diameter NS, at its bottom by a lower rib having diameter NI, and by an upper ring and a lower ring both having diameter DM defining a major diameter of the container, where a NI/DM ratio is comprised between 0.75 and 0.85 and where the a NS/DM ratio is comprised between 0.85 and 0.92.

3. The compressible container according to claim 2, wherein the NI/DM ratio is comprised between 0.78 and 0.82 and the NS/DM ratio is comprised between 0.88 and 0.92.

4. The compressible container according to claim 2, wherein there is provided an inclined column between each pair of compensation panels of said four compensation panels, wherein each inclined column connects said lower ring and said upper ring, and wherein each inclined column has a depth P in radial direction comprised between 2.5 and 5 mm.

5. The compressible container according to claim 4, wherein said depth P is between 2.8 and 3.2 mm.

6. The compressible container according to claim 1, wherein each recess of said two recesses has a width W equal to 0.5 times the major base length.

7. The compressible container according to claim 1, wherein the compensation panels have an even surface, curved towards the longitudinal symmetry axis X without any dips and any protrusions.

8. The compressible container according to claim 1, wherein the compensation panels have identical shape and dimensions.

9. The compressible container according to claim 1, wherein said vacuum compensation area has a second length h comprised between ½H and ⅔H.

10. A compressible container for a drink, made of plastic material, suitable for a hot-filling process, having a longitudinal symmetry axis X, and having a first length H along said longitudinal symmetry axis X, the compressible container comprising:

a) a cylindrical threaded neck for a passage of the drink, b) a shoulder, c) a closed bottom, d) a central body having side walls, comprised between said shoulder and said closed bottom, and defining a vacuum compensation area comprising four compensation panels arranged along the side walls of said central body, each compensation panel of said four compensation panels having a trapezoidal shape with a minor base length to major base length ratio comprised between 0.20 and 0.35, and having a minor base and a major base inverted with respect to an adjacent compensation panel, wherein the closed bottom is provided with two recesses made in a peripheral portion of the closed bottom and positioned symmetrically with respect to a diametrical line passing through a center of the closed bottom, each recess of said two recesses being in a position corresponding to a compensation panel of said four compensation panels having the major base facing the shoulder, the width W of each recess of said two recesses being comprised between said minor base length and said major base length.

11. The compressible container according to claim 10, wherein the closed bottom is provided with a central portion which is provided with further recesses.

12. The compressible container according to claim 11, wherein said further recesses are positioned symmetrically with respect to a diametrical line passing through a center of the closed bottom.

13. The compressible container according to claim 10, wherein there are provided only two recesses made in a peripheral portion of the closed bottom.

14. The compressible container according to claim 10, wherein the closed bottom is provided with a central portion which is reentrant with respect to said peripheral portion.

* * * * *